US008602414B2

(12) United States Patent
Osaki

(10) Patent No.: US 8,602,414 B2
(45) Date of Patent: Dec. 10, 2013

(54) SEPARATING DEVICE, FIXING DEVICE, MEDIUM CONVEYING DEVICE AND IMAGE FORMING APPARATUS

(75) Inventor: Koji Osaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/064,292

(22) Filed: Mar. 16, 2011

(65) Prior Publication Data

US 2011/0227273 A1 Sep. 22, 2011

(30) Foreign Application Priority Data

Mar. 17, 2010 (JP) ..... 2010-061375

(51) Int. Cl.
*B65H 29/54* (2006.01)

(52) U.S. Cl.
USPC ..... 271/311; 399/323

(58) Field of Classification Search
USPC ..... 271/311, 312, 313; 399/323, 398, 399
See application file for complete search history.

(56) References Cited

U.S. PATENT DOCUMENTS

| | | | | |
|---|---|---|---|---|
| 5,392,108 | A * | 2/1995 | DeWaters et al. | 399/399 |
| 6,205,316 | B1 * | 3/2001 | Iida | 399/323 |
| 2007/0048036 | A1 * | 3/2007 | Kanematsu et al. | 399/323 |
| 2007/0116498 | A1 | 5/2007 | Nakano et al. | |

FOREIGN PATENT DOCUMENTS

| | | | |
|---|---|---|---|
| JP | 3-245173 | * | 10/1991 |
| JP | 5-134554 | * | 5/1993 |
| JP | 2001-235958 | A | 8/2001 |
| JP | 2004-170905 | A | 6/2004 |
| JP | 2006-126876 | A | 5/2006 |
| JP | 2008-111906 | * | 5/2008 |
| JP | 2008-224833 | A | 9/2008 |

OTHER PUBLICATIONS

Machine translation of JP 2008-111906.*

* cited by examiner

*Primary Examiner* — Thomas Morrison
(74) *Attorney, Agent, or Firm* — Rabin & Berdo, P.C.

(57) ABSTRACT

A separating device includes a carrying-out portion for carrying-out a medium, and a conveying portion for conveying the medium carried out by the carrying-out portion. A separating portion is provided between the carrying-out portion and the conveying portion, and is rotatable about a rotation fulcrum. The separating portion has an end portion separably contacts the carrying-out portion to separate the medium therefrom. The separating portion includes a first guiding portion rotatably provided for guiding the medium separated from the carrying-out portion to the conveying portion. The first guiding portion is provided between the carrying-out portion and the conveying portion, and has a rotation center located on the carrying-out portion side with respect to the rotation fulcrum. When a straight line is defined by connecting contact areas of the carrying-out portion and the conveying portion, the rotation center is located on the straight line side with respect to the rotation fulcrum.

12 Claims, 15 Drawing Sheets

SEPARATING DEVICE, FIXING DEVICE, MEDIUM CONVEYING DEVICE AND IMAGE FORMING APPARATUS

BACKGROUND OF THE INVENTION

The present invention relates to a separating device, a fixing device, a medium conveying device, and an image forming apparatus.

Conventionally, in an image forming apparatus such as a laser printer or a copier, a sheet (i.e., a medium) is fed by a feeding cassette, and then conveyed by registration rollers to an image forming portion while a skew of the sheet is corrected. The image forming portion transfers a toner image to the sheet, and conveys the sheet to a fixing device. The fixing device fixes the toner image to the sheet by applying heat and pressure.

For example, Japanese Laid-open Patent Publication No. 2006-126876 discloses a separating claw for separating the sheet adhering to a roller.

Recently, there is a demand for a technique capable of surely separating a sheet from a roller even when the sheet is thin and has a tendency to wind around the roller.

SUMMARY OF THE INVENTION

An aspect of the present invention is intended to provide a separating device, a fixing device, a medium conveying device and an image forming apparatus capable of surely separating a thin medium.

According to an aspect of the present invention, there is provided a separating device including a carrying-out portion for carrying-out a medium, a conveying portion for conveying the medium carried out by the carrying-out portion, and a separating portion provided between the carrying-out portion and the conveying portion so as to be rotatable about a rotation fulcrum. The separating portion has an end portion which is contactable and separable with the carrying-out portion. The end portion of the separating portion contacts the carrying-out portion to thereby separate the medium from the carrying-out portion. The separating portion includes a first guiding portion rotatably provided for guiding the medium separated from the carrying-out portion to the conveying portion. The first guiding portion is located between the carrying-out portion and the conveying portion, and has a rotation center which is located on the carrying-out portion side with respect to the rotation fulcrum of the separating portion. When a straight line is defined by connecting a contact area of the carrying-out portion and a contact area of the conveying portion, the rotation center of the first guiding portion is located on the straight line side with respect to the rotation fulcrum of the separating portion.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

[Configuration]

Figure 1:
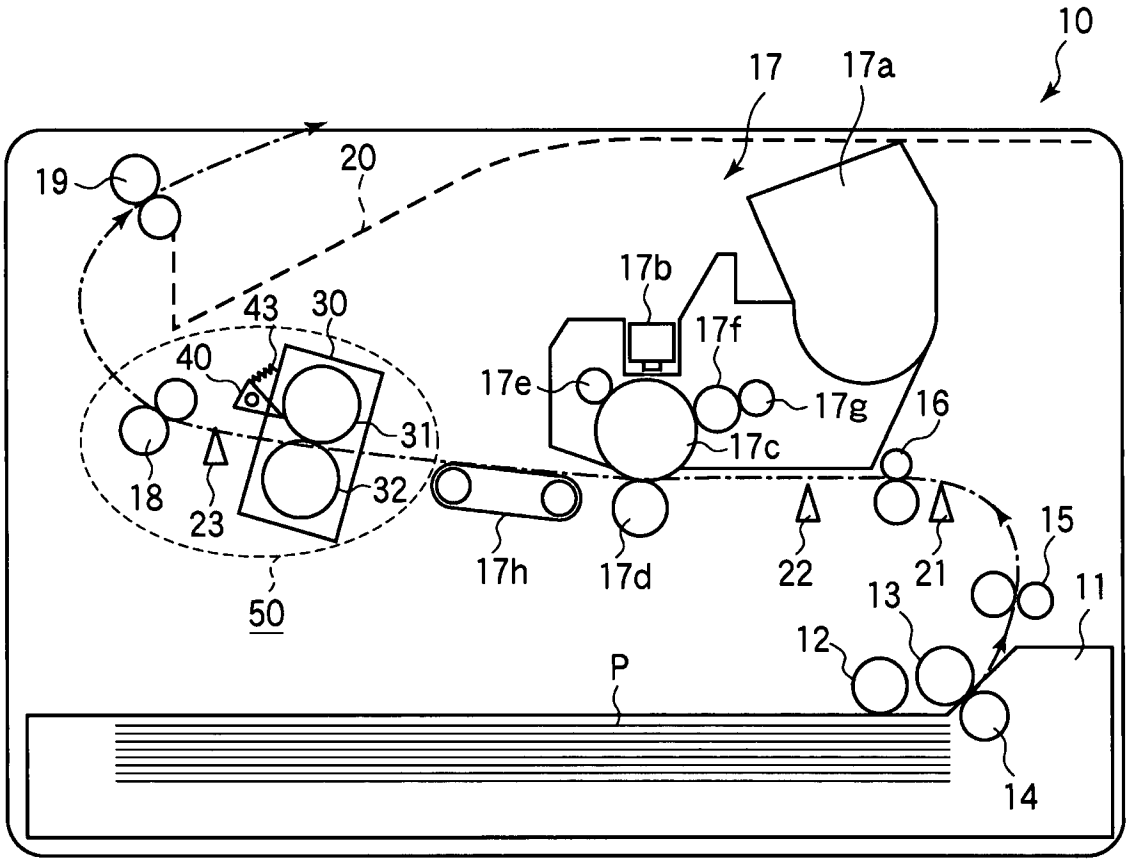
FIG. 1 is a schematic view showing a configuration of an image forming apparatus according to the first embodiment of the present invention.

FIG. 1 is a schematic view showing a configuration of an image forming apparatus 10 according to the first embodiment of the present invention.

The image forming apparatus 10 is configured as, for example, an electrophotographic page printer. The image forming apparatus 10 includes a sheet cassette (i.e., a medium cassette) 11 in which sheets P as media are stored. The sheet cassette 11 is detachably mounted to a lower part of the image forming apparatus 10. A pickup roller 12 is rotatably provided above the sheet cassette 11, and the pickup roller 12 is pressed against the uppermost sheet of the sheets P stored in the sheet cassette 11. A conveying roller 13 and a retard roller 14 are provided so as to face each other in the vicinity of the pickup roller 12. The conveying roller 13 and the retard roller 14 convey the sheet P upward from the sheet cassette 11.

A conveying roller pair 15 (i.e., a pair of conveying rollers) is rotatably provided above the conveying roller 13 and the retard roller 14. Further, a conveying roller pair 16 is rotatably provided on downstream side of the conveying roller pair 15 along a conveying path of the sheet P. The conveying roller pair 16 conveys the sheet P to an image forming portion 17 provided on further downstream side of the conveying roller 16.

Hereinafter, the terms "downstream" and "upstream" will be used to respectively refer to downstream direction and upstream direction along the conveying path of the sheet P (i.e., a path along which the sheet P is conveyed) shown by a dashed line in FIG. 1. Further, the terms "above" and "below" are defined based on a vertical direction.

The image forming portion 17 includes a toner cartridge 17*a* as a developer storage portion, a recording head 17*b* as an exposure unit, a photosensitive drum 17*c* as an image bearing body, a charging roller 17*e* as a charging member, a developing roller 17*f* as a developer bearing body, a developing blade (not shown) as a developer layer forming member, a supplying roller 17*g* as a developer supplying member, and a transfer roller 17*d* as a transferring portion. The image forming portion 17 is configured to form a toner image (as a developer image) in accordance with a printing job data, and transfer the toner image to the conveyed sheet P.

The toner cartridge 17*a* stores a toner as a developer to be supplied to other portion of the image forming portion 17. The photosensitive drum 17*c* bears a latent image which is developed (i.e., visualized) using the toner supplied by the developing roller 17*f*. The charging roller 17*e* uniformly charges a surface of the photosensitive drum 17*c*. The recording head 17*b* emits light to expose the surface of the photosensitive drum 17*c* to form a latent image thereon. The developing roller 17*f* develops the latent image by supplying the toner to the photosensitive drum 17*c* so as to form a toner image as a developer image. The developing blade regulates a thickness of the toner layer on the developing roller 17*f*. The supplying roller 17*g* supplies the developer to the developing roller 17*f*.

The transfer roller 17*d* transfers the toner image as the developer image from the photosensitive drum 17*c* to the sheet P, and conveys the sheet P to a fixing device 50 as a separating device.

The fixing device 50 as the separating device is provided on downstream side of the image forming portion 17. The image forming portion 17 further includes a conveying belt unit 17*h* as a medium operating portion that conveys the sheet P at a predetermined timing and supplies the sheet P to the fixing device 50. The conveying belt unit 17*h* (as the medium operating portion) and the fixing device 50 (as the separating device) constitute a medium conveying device.

The fixing device 50 includes a fixing portion 30 as a carrying-out portion, and a separating claw unit 40 as a separating portion that separates the sheet P (carried out by the fixing portion 30) from the fixing portion 30, a spring 43 as a biasing portion that biases the separating claw unit 40 in a direction in which the separating claw unit 40 contacts the fixing portion 30, and a conveying roller pair 18 as a conveying portion that conveys the sheet P having passed the separating claw unit 40.

The fixing portion 30 is configured to fix the toner image (having been transferred to the sheet P) to the sheet P by application of heat and pressure. The fixing portion 30 includes a heat roller 31, and a pressure roller 32 pressed against the heat roller 31.

The conveying roller pair 18 is provided on downstream side of the fixing portion 30. An ejection roller pair 19 is provided above the conveying roller pair 18. The ejection roller pair 19 is configured to eject the sheet P to the outside of the image forming apparatus 10. An ejection tray 20 is provided on a top of the image forming apparatus 10 for stacking the sheet P ejected by the ejection roller pair 19.

Sensors 21, 22 and 23 are provided for detecting positions of the sheet P. The sensor 21 is provided in the vicinity of and on upstream side of the conveying roller pair 16. The sensor 22 is provided between the conveying roller pair 16 and the transfer roller 17*d*. The sensor 23 is provided between the fixing portion 30 and the conveying roller pair 18.

Figure 2:
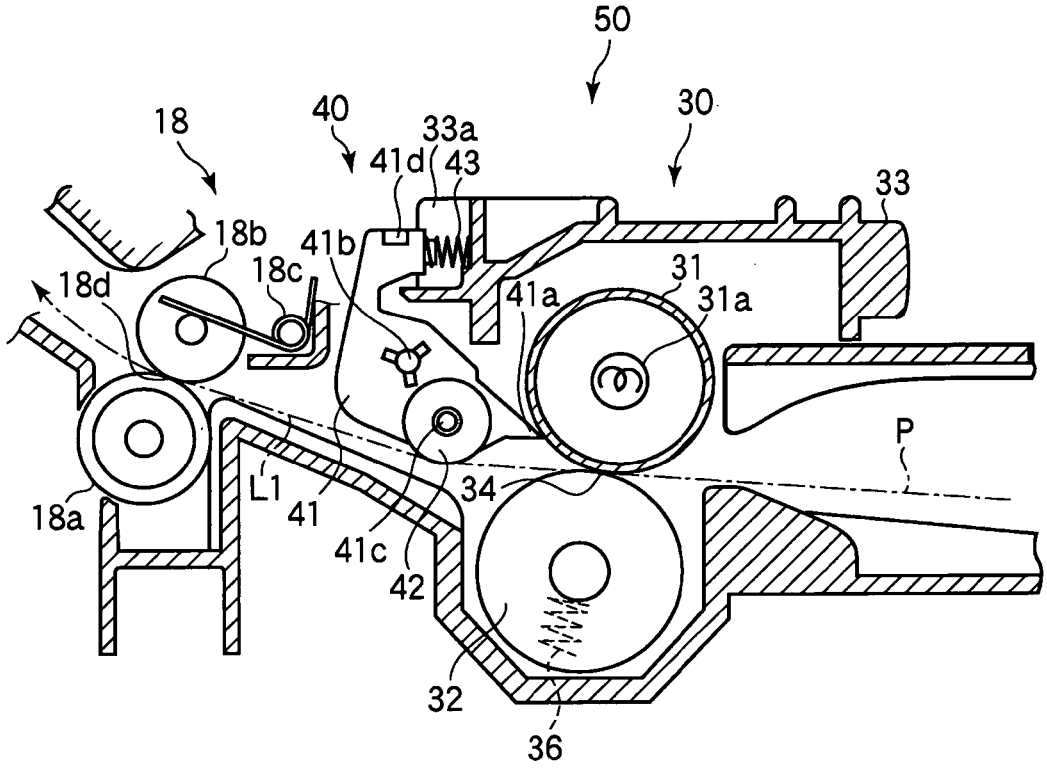
FIG. 2 is a sectional view showing a configuration of a fixing device of the image forming apparatus according to the first embodiment.
Figure 3:
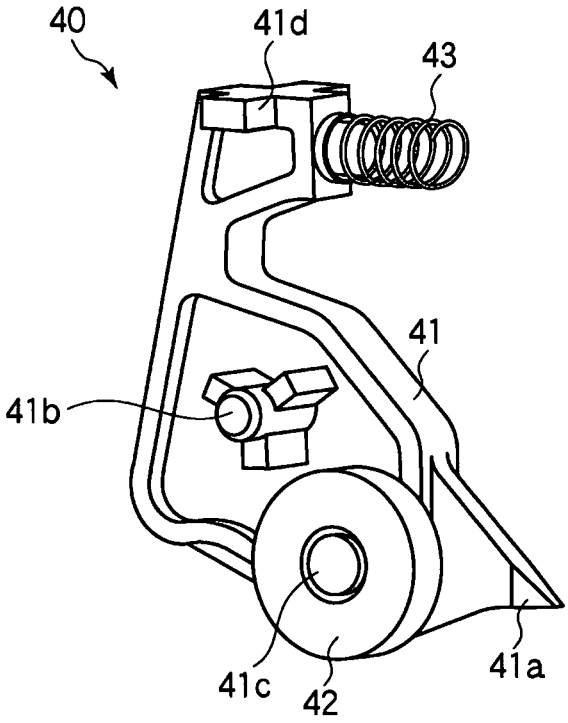
FIG. 3 is a perspective view showing a separating claw unit according to the first embodiment.

FIG. 2 is a sectional view showing a configuration of the fixing device 50 according to the first embodiment. FIG. 3 is a perspective view showing the separating claw unit 40 according to the first embodiment.

As shown in FIG. 2, the fixing portion 30 includes a rotatable heat roller 31 (e.g., an exemplary first fixing member), and a rotatable pressure roller 32 (e.g., an exemplary second fixing member) provided below the heat roller 31. The pressure roller 32 is pressed against the heat roller 31 by means of a spring 36 (shown by a dashed line in FIG. 2) as a biasing member. The fixing portion 30 further includes a fixing portion cover 33 covering the heat roller 31 and the pressure roller 32. A stopper 33*a* is provided on an end of the fixing portion cover 33. The stopper 33*a* contacts an upper part of the separating claw unit 40 so as to limit a rotation of the separating claw unit 40. The heat roller 31 has a halogen lamp 31*a* as a heat source therein.

As shown in FIGS. 2 and 3, the separating claw unit 40 is provided so as to be rotatable with respect to the fixing portion cover 33. The separating claw unit 40 has a function to separate the sheet P from the heat roller 31 when the sheet P adheres to and winds around the heat roller 31.

The separating claw unit 40 as the separating portion includes a separating claw 41 and a guide roller 42 as a first guide portion. The separating claw 41 includes a separating claw end 41*a*, a rotation fulcrum 41*b*, a rotation center 41*c* and a separating claw projection 41*d*. The separating claw unit 40 as the separating portion is rotatable about the rotation fulcrum 41*b* with respect to the heat roller 31 of the fixing portion 30 as the carrying-out portion. Further, the spring 43 as the biasing portion biases the separating claw unit 40 to cause the separating claw unit 40 to rotate in a direction (counterclockwise in FIG. 2) in which the separating claw end 41*a* contacts the heat roller 31. The guide roller 42 as the first guide portion is rotatable about the rotation center 41*c* with respect to the separating claw unit 40. The separating claw projection 41*d* (see FIG. 3) is located at a position to abut against the stopper 33*a* to thereby limit the rotation of the separating claw unit 40 in a direction in which the separating claw end 41*a* separates (moves away) from the heat roller 31.

The separating claw end 41*a* of the separating claw 41 has a pointed shape narrowing toward the heat roller 31. The guide roller 42 as the first guide portion guides the sheet P having been separated from the heat roller 31 by the separating claw 41. The separating claw projection 41*d* is formed on the upper part of the separating claw 41 to which the spring 43 as the biasing member is mounted. The rotation fulcrum 41*b* is located on a substantially center of the separating claw 41. The rotation fulcrum 41*b* is supported by the fixing portion cover 33, and rotatably supports the separating claw unit 40.

As shown in FIG. 2, the rotation center 41*c* of the guide roller 42 is located below the rotation fulcrum 41*b* of the separating claw 41, and is located on the heat roller 31 side with respect to the rotation fulcrum 41*b* of the separating claw 41. A lower end of an outer circumference of the guide roller 42 protrudes downward from a straight line L0 (see FIG. 5) connecting a contact area 34 (in this example, a nip portion) of the fixing portion 30 and a contact area 18*d* (in this example, a nip portion) of the conveying roller pair 18.

The separating claw 41 is so shaped that a part of the separation claw 41 on downstream side of the guide roller 42 does not protrude downward from a straight line L1 connecting the lower end of the outer circumference of the guide roller 42 and the nip portion 18*d* of the conveying roller pair 18. The spring 43 is provided above the rotation fulcrum 41*b* of the separating claw 41. The spring 43 biases the separating claw 41 to the left in FIG. 1, i.e., in a direction to rotate the separating claw 41 counterclockwise so that the separating claw end 41*a* is pressed against the heat roller 31.

The conveying roller pair 18 is provided on downstream side of the separating claw unit 40. The conveying roller pair 18 includes a rotatable conveying roller 18*a* (e.g., an exemplary first conveying member), and a rotatable pinch roller 18*b* (e.g., an exemplary second conveying member) provided above the conveying roller 18*a*. The pinch roller 18*b* is pressed against the conveying roller 18*a* by a spring 18*c* with a predetermined biasing force.

Figure 4:
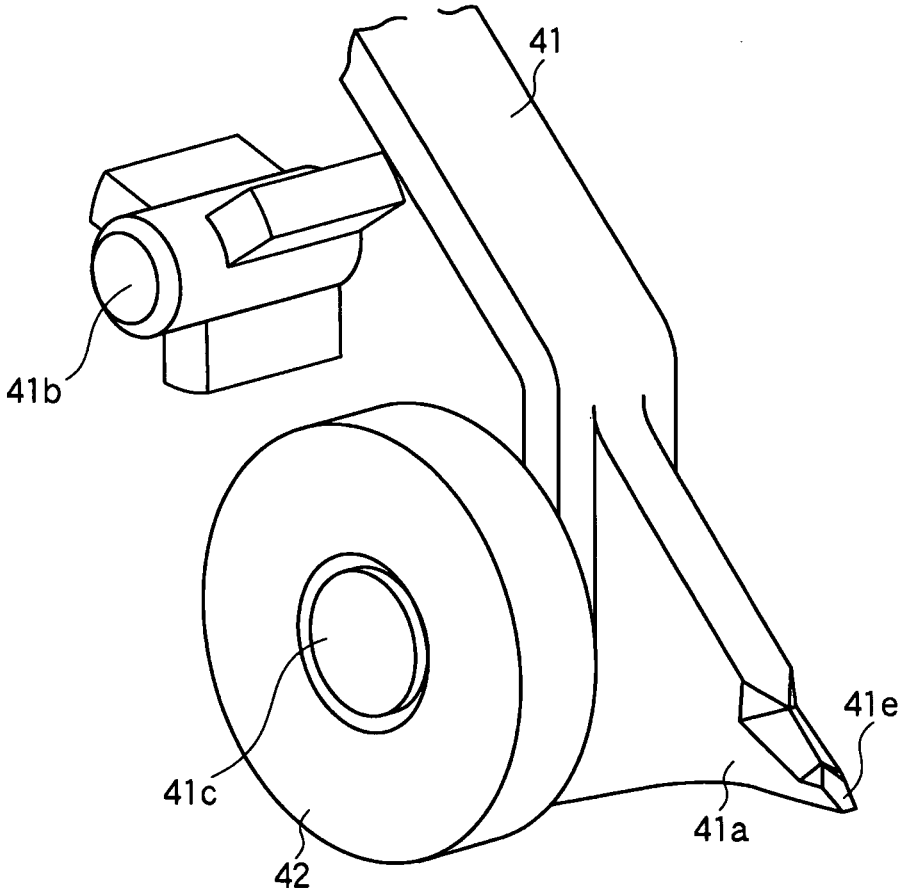
FIG. 4 is an enlarged perspective view showing a separating claw end and its surroundings according to the first embodiment.

FIG. 4 is an enlarged perspective view showing the separating claw end 41*a* of the separating claw unit 40 and its surroundings.

As described above, the separating claw end 41*a*, the rotation fulcrum 41*b*, the guide roller 42, and the rotation center 41*c* of the guide roller 42 are provided on a lower part of the separating claw unit 40. The separating claw end 41*a* has an end surface 41*e* that contacts the heat roller 31. The end surface 41*e* has a small surface area. With such a configuration, toner is not likely to be deposited on the end surface 41*e* of the separating claw end 41*a*. Therefore, a surface and a back surface of the sheet P can be prevented from being smeared with the toner.

Figure 5:
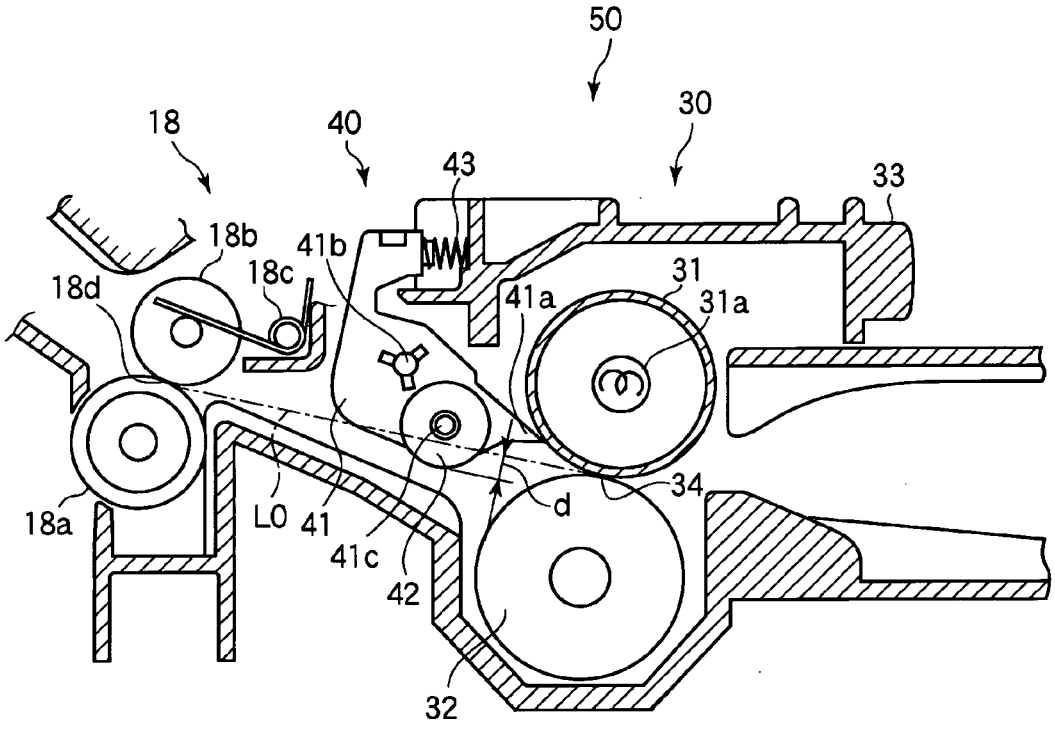
FIG. 5 is a side view for illustrating a protruding amount of a lower end of an outer circumference of a guide roller from a straight line connecting contact areas of a fixing portion and a conveying portion.

FIG. 5 is a schematic view for illustrating a protruding amount of the lower end of the outer circumference of the guide roller 42 with respect to the above described line L0.

As shown in FIG. 5, the lower end of the outer circumference of the guide roller 42 protrudes downward from the straight line L0 connecting the nip portion 34 (as the contact area) of the fixing portion 30 and the nip portion 18*d* (as the contact area) of the conveying roller pair 18. To be more specific, the straight line L0 is defined by connecting a terminal point of the nip portion 34 between the heat roller 31 and the pressure roller 32 and a starting point of the nip portion 18*d* between the conveying roller 18*a* and the pinch roller 18*b*. The lower end of the outer circumference of the guide roller 42 protrudes downward from the straight line L0.

If the heat roller 31 and the pressure roller 32 contact each other at a point (referred to as a first contact point) without forming the nip portion 34, and the conveying roller 18*a* and the pinch roller 18*b* contact each other at a point (referred to as a second contact point) without forming the nip portion 18*d*, the straight line L0 is defined by connecting the first contact point and the second contact point. If the heat roller 31 and the pressure roller 32 form the nip portion 34, and the conveying roller 18*a* and the pinch roller 18*b* form the nip portion 18*d*, the straight line L0 is defined by connecting the terminal point of the nip portion 34 and the starting point of the nip portion 18*d*.

If the heat roller 31 and the pressure roller 32 form the nip portion 34, and the conveying roller 18*a* and the pinch roller 18*b* contact each other at the second contact point without forming the nip portion 18*d*, the straight line L0 is defined by connecting the terminal point of the nip portion 34 and the second contact point. If the heat roller 31 and the pressure roller 32 contact each other at the first contact point without forming the nip portion 34, and the conveying roller 18*a* and the pinch roller 18*b* form the nip portion 18*d*, the straight line L0 is defined by connecting the first contact point and the starting point of the nip portion 18*d*.

[Operation of Image Forming Apparatus]

An operation of the image forming apparatus 10 of the first embodiment will be described.

The sheet P is fed out of the sheet cassette 11 by the pickup roller 12, and is further conveyed by the conveying roller 13, the retard roller 14 and the conveying roller pairs 15 and 16 to reach the image forming portion 17. In the image forming portion 17, the charging roller 17*e* uniformly charges the surface of the photosensitive drum 17*c*. The recording head 17*b* receives a printing job (sent from a host device) via a not shown control unit, and emits light to expose the surface of the photosensitive drum 17 in accordance with a printing pattern, so as to form a latent image on the surface of the photosensitive drum 17.

The developing roller 17*f* is provided in contact with the photosensitive drum 17*c*, and causes the toner to adhere to the latent image on the surface of the photosensitive drum 17*c* so that a toner image is formed thereon. The toner image is transferred from the photosensitive drum 17*c* to the sheet P due to electric field between the photosensitive drum 17*c* and the transfer roller 17*d*. Then, the toner image is fixed to the sheet P by the fixing portion 30. The sheet P is ejected by the conveying roller pair 18 and the ejection roller pair 19 to the ejection tray 20.

[Operation of Fixing Device]

Figure 6:
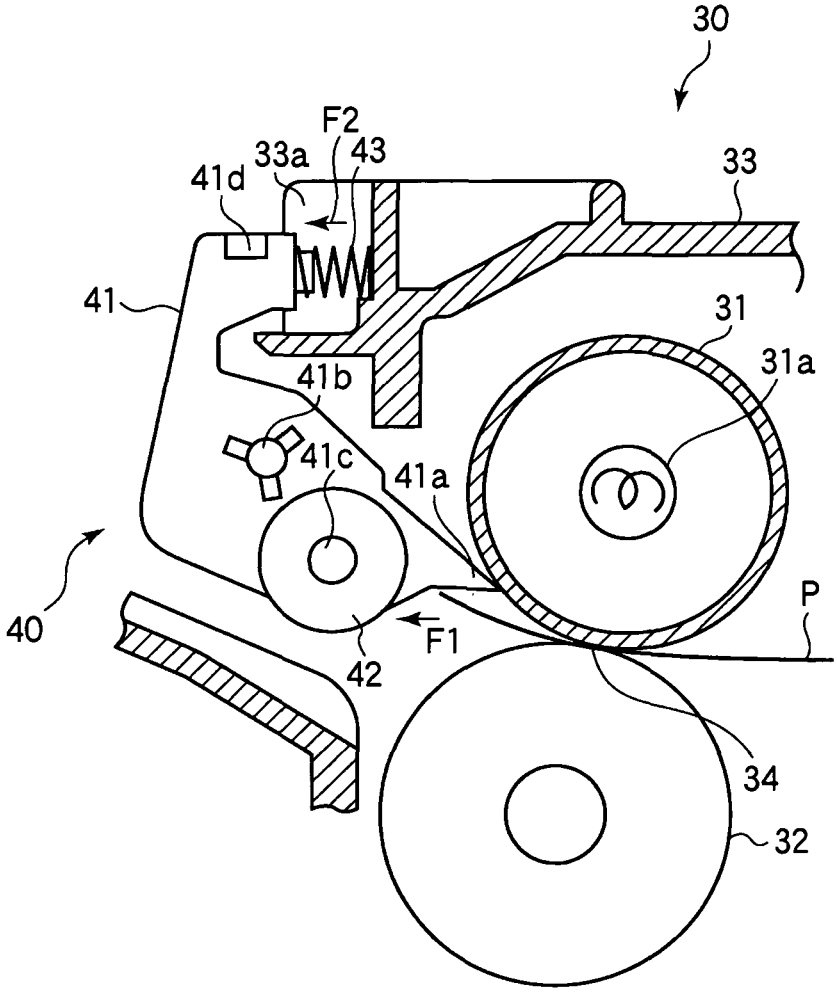
FIG. 6 is a schematic view showing a first state during a passage of a sheet through the fixing portion according to the first embodiment.

FIG. 6 is a schematic view for illustrating a first state of the separating claw unit 40 during the passage of the sheet P through the fixing portion 30.

The first state shown in FIG. 6 is a state after a leading end of the sheet P has passed the nip portion 34 between the heat roller 31 and the pressure roller 32, and just before the leading end of the sheet P reaches the guide roller 42.

The leading end of the sheet P having passed the nip portion 34 passes a vicinity of the heat roller 31, and is conveyed along a vicinity of the separating claw end 41*a*. The separating claw end 41*a* contacts the heat roller 31 by the force F of the spring 43 as the biasing member, and therefore it is ensured that the sheet P is separated from the heat roller 31 and conveyed along the separating claw end 41*a*, even when the sheet P is thin and has a tendency to wind around the heat roller 31. In this state, the separating claw end 41*a* is kept in contact with the heat roller 31. A rotational friction force of the guide roller 42 and the separating claw unit 40 (about the rotation fulcrum 41*b*) is expressed as F1. A force of the spring 43 (as the biasing member) when the separating claw end 41*a* contacts the heat roller 31 is expressed as F2. It is preferable to satisfy the relationship F1<F2.

Figure 7:
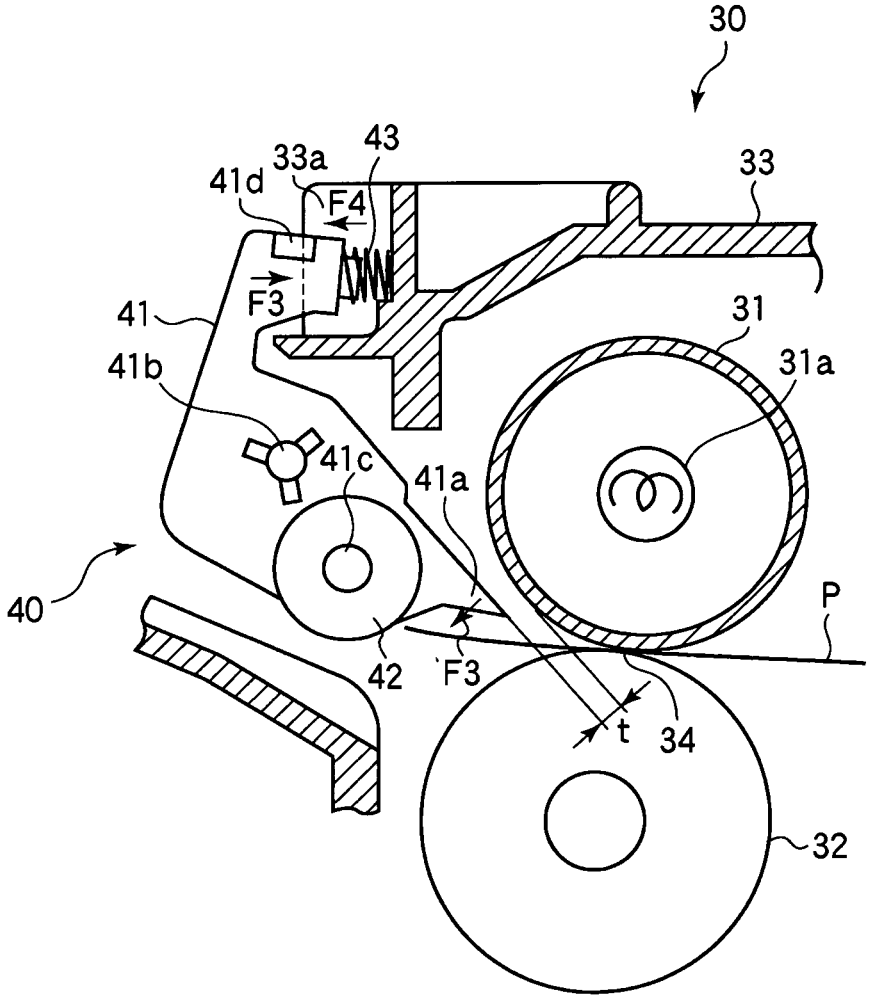
FIG. 7 is a schematic view showing a second state during the passage of the sheet through the fixing portion according to the first embodiment.

FIG. 7 is a schematic view for illustrating a second state of the separating claw unit 40' during the passage of the sheet P through the fixing portion 30.

The second state shown in FIG. 7 is a state where the leading end of the sheet P contacts the guide roller 42.

When the leading end of the sheet P (having been conveyed along the vicinity of the separating claw end 41*a*) contacts the guide roller 42, the separating claw unit 40 is forced by the sheet P, and rotates about the rotation fulcrum 41*b* resisting the force of the spring 43 so that the separating claw end 41*a* moves apart from the heat roller 31.

In this state, a separating amount "t" between the separating claw end 41*a* and the heat roller 31 is determined by a position of the separating claw 41 when the separating claw projection 41*d* on the upper part of the separating claw 41 contacts the stopper 33*a* provided on the fixing portion cover 33 in the vicinity of the separating claw projection 41*d*. The separating amount "t" is determined so that the separating claw end 41*a* having reached a lower end of a movable range thereof does not contact the sheet P.

When the leading end of the sheet P contacts the guide roller 42, the separating claw unit 40 is applied with a force F3 by the sheet P, and rotates clockwise. When a biasing force (i.e., a spring force) F4 of the spring 43 exceeds the force F3 (i.e., F4>F3), the separating claw 41 is brought into contact with the heat roller 31 due to the force F4 of the spring 43.

In this regard, there may be a case where the biasing force F4 is smaller than the force F3 (i.e., F4<F3) until the separating claw projection 41*d* abuts against the stopper 33*a*. However, even in such a case, when the separating claw projection 41*d* abuts against the stopper 33*a*, the guide roller 42 starts rotating, and therefore the force F3 (causing the separating claw unit 40 to rotate clockwise) decreases. Therefore, the force F3 becomes smaller than the biasing force F4 (i.e., F4>F3), and the separating claw unit 40 is brought into contact with the heat roller 31 due to the biasing force F4 of the spring 43.

In other words, after the leading end of the sheet P has passed the guide roller 42, the separating claw unit rotates counterclockwise by the biasing force of the spring 43, so that the separating claw end 41*a* contacts the heat roller 31.

Further, even if the sheet P is curled in the same direction as a curvature of the heat roller 31 or in the opposite direction, the separating claw unit 40 operates in a similar manner as described above when the leading end of the sheet P (having been separated from the heat roller 31 by the separating claw end 41*ad*) contacts the guide roller 42.

Figure 8:
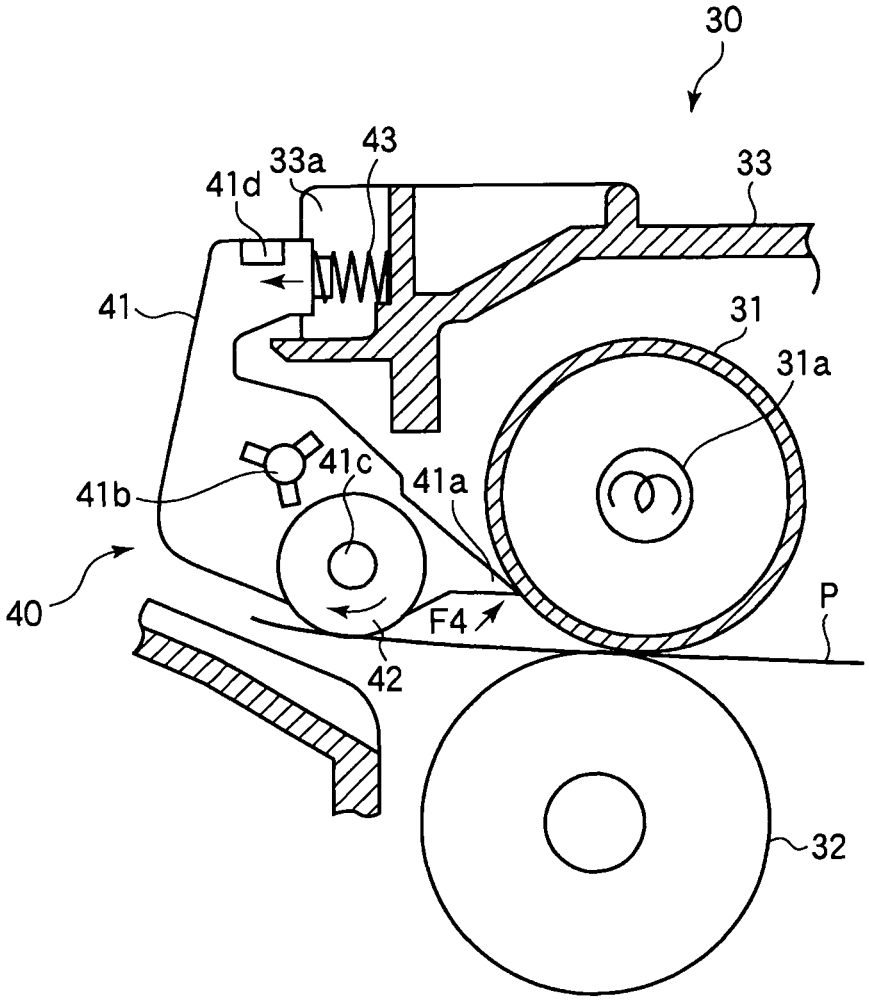
FIG. 8 is a schematic view showing a third state during the passage of the sheet through the fixing portion according to the first embodiment.

FIG. 8 is a schematic view showing a third state of the separating claw unit 40 during the passage of the sheet P through the fixing portion 30.

The third state shown in FIG. 8 is a state where the guide roller 42 starts rotating clockwise by being forced by the sheet P and the leading end of the sheet P passes the guide roller 42, after the separating claw unit 40 has rotated to cause the separating claw unit end 41*a* to separate from the heat roller 31*a*.

In the third state shown in FIG. 8, after the sheet P has passed the guide roller 42, the force causing the separating claw unit 40 to rotate clockwise (in FIG. 8) disappears, and therefore the separating claw end 41*a* contacts the heat roller 31 due to the biasing force of the biasing spring 43. Thereafter, the sheet P is conveyed by the conveying roller pair 18 shown in FIG. 2. While the sheet P is conveyed by the conveying roller pair 18, the separating claw end 41*a* is kept in contact with the heat roller 31. Further, after a tail end of the sheet P has passed the separating claw 41, the separating claw end 41*a* is kept in contact with the heat roller 31.

Figure 9:
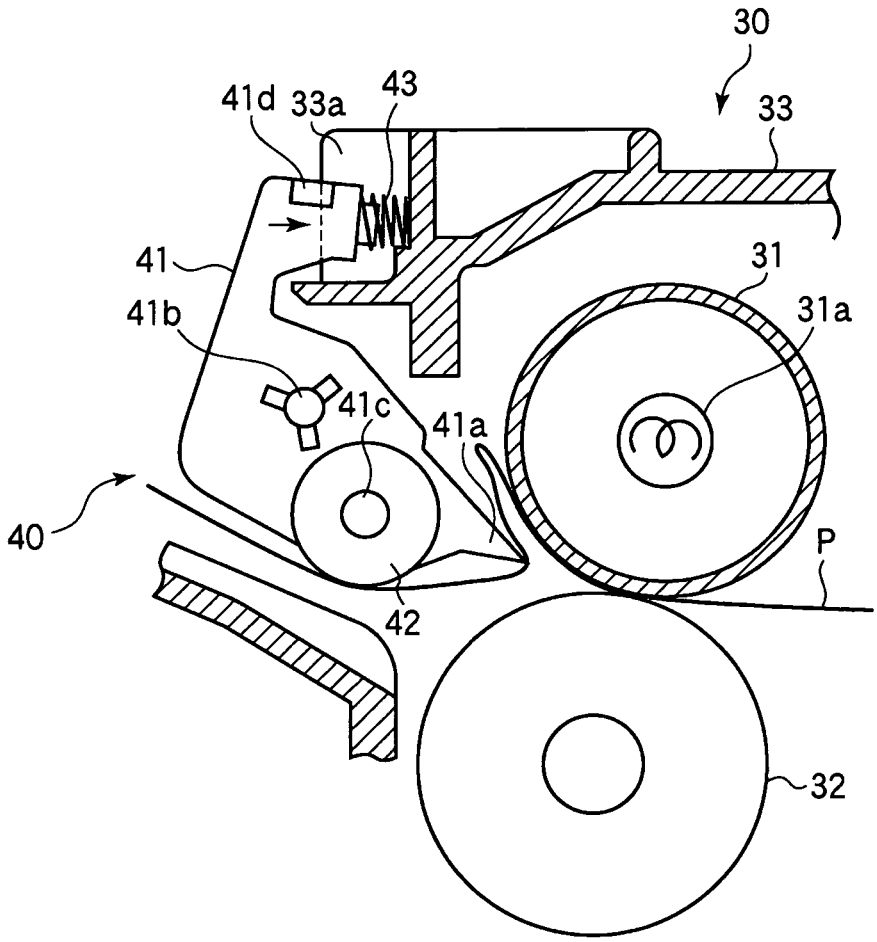
FIG. 9 is a schematic view showing a state where a jam of the sheet occurs.

FIG. 9 is a schematic view showing a state where a jam of the sheet P occurs.

As described above, after the leading end of the sheet P has passed the guide roller 42, the force causing the separating claw unit 40 to rotate clockwise disappears, and the separating claw end 41*a* contacts the heat roller 31 due to the biasing force of the spring 43 as shown in FIG. 8. In this regard, if the separating claw end 41*a* remains apart from the heat roller 31 after the leading end of the sheet P has passed the guide roller 42, and if the sheet P is a thin sheet having a tendency to wind around the heat roller 31, a part (for example, other than the leading end) of the sheet P may enter into a gap between the separating claw end 41*a* and the heat roller 31, which may cause a jam or the like to occur. In contrast, according to the first embodiment, the separating claw end 41*a* contacts the heat roller 31 after the leading end of the sheet P has passed the guide roller 42 as shown in FIG. 8, and therefore the occurrence of jam can be prevented.

[Advantages]

The first embodiment of the present invention provides the following advantages.

(1) The guide roller 42 is provided on the separating claw 41 at a different position from the rotation fulcrum 41*b* of the separating claw 41, and the spring 43 generates a relatively small biasing force and allows the rotation of the separating claw unit 40 when the guide roller 42 is forced by the leading end of the sheet P. With such a configuration, the separating claw end 41*a* moves apart from the heat roller 31 for a short time period when the leading end of the sheet P passes the guide roller 42. As a result, even when the sheet P is a thin sheet having a tendency to wind around the heat roller 31 and is not sufficiently separated from the heat roller 31, the separating claw end 41*a* can separates the sheet P from the heat roller 31. As a result, the occurrence of jam of the sheet P can be prevented.

(2) Further, the separating claw end 41*a* is apart from the heat roller 31 only when the sheet P passes the guide roller 42, and therefore deposition of the toner (or other extraneous matter) on the separating claw end 41*a* is not likely to occur. As a result, a surface and a back surface of the sheet P can be prevented from being smeared with the toner or other extraneous matter.

(3) Furthermore, by the rotation of the separating claw unit 40 about the rotation fulcrum 41*b*, the separating claw end 41*a* can move apart from the heat roller 31 along the conveying direction of the sheet P. Therefore, when the sheet P contacts the guide roller 42, the force applied to the separating claw unit 40 by the sheet P can be dispersed in the conveying direction of the sheet P. Therefore, wrinkling, folding or jam of the sheet P (that may otherwise occur when the sheet P contacts the first guide roller 42) can be prevented.

Second Embodiment

[Configuration]

Figure 10:
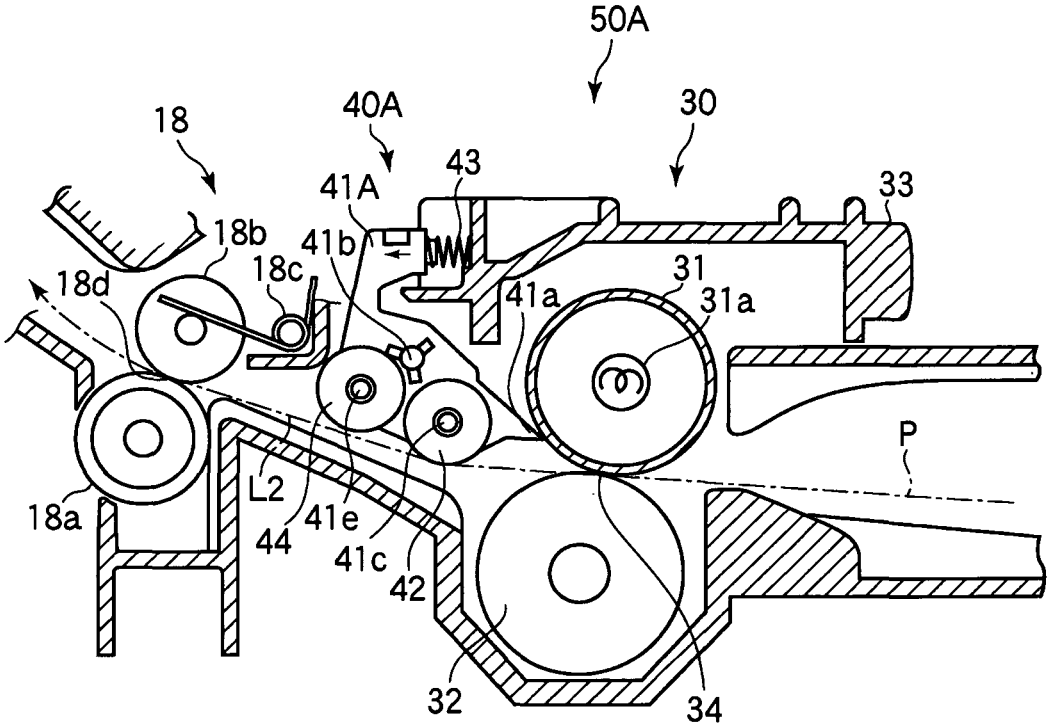
FIG. 10 is a sectional view showing a configuration of a fixing device according to the second embodiment of the present invention.
Figure 11:
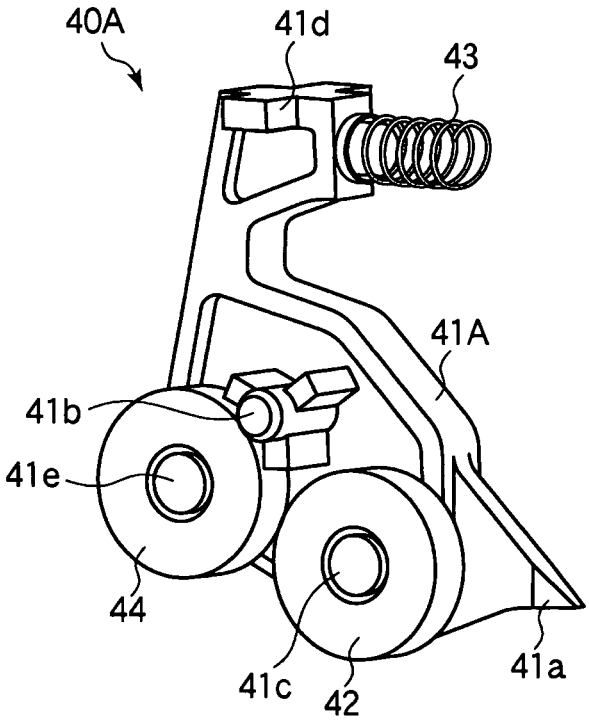
FIG. 11 is a perspective view showing a separating claw unit according to the second embodiment.

FIG. 10 is a sectional view showing a configuration of a fixing device 50A according to the second embodiment of the present invention. FIG. 11 is a perspective view showing a separating claw unit 40A of the second embodiment. In FIGS. 10 and 11, elements that are the same as those of the first embodiment (FIGS. 2 and 3) are assigned the same reference numerals.

The fixing device 50A of the second embodiment has substantially the same configuration as the fixing device 50 of the first embodiment. The separating claw unit 40A of the fixing device 50A of the second embodiment is different from the separating claw unit 40 of the first embodiment in that the separating claw unit 40A has a guide roller 44 in addition to the guide roller 42. The guide roller 44 is provided on downstream side of the guide roller 42 that guides the sheet P having been separated from the heat roller 31 by the separating claw end 41*a* having the same configuration as in the first embodiment.

As shown in FIG. 10, the separating claw unit 40A as a separating portion includes a separating claw 41A, the guide roller 42 as a first guide portion and the guide roller 44 as a second guide portion. The separating claw 41A includes a separating claw end 41*a*, a rotation fulcrum 41*b*, a rotation center 41*c*, a separating claw projection 41*d* and a rotation center 41*e*. The separating claw unit 40A as the separating portion is rotatable about the rotation fulcrum 41*b* with respect to the heat roller 31 of the fixing portion 30 as the carrying-out portion. Further, the spring 43 as the biasing portion biases the separating claw unit 40A so that the separating claw unit 40A rotates in a direction in which the separating claw end 41*a* contacts the heat roller 31. The guide roller 42 as the first guide portion is rotatable about the rotation center 41*c* with respect to the separating claw unit 40A. The guide roller 44 as the second guide portion is rotatable about the rotation center 41*e* with respect to the separating claw unit 40A. The separating claw projection 41*d* is provided so as to abut against the stopper 33*a* to limit the rotation of the separating claw unit 40A in a direction in which the separating claw end 41*a* moves away from the heat roller 31.

As described in the first embodiment, the rotation center 41*c* of the guide roller 41 is located on the heat roller 31 side with respect to the rotation fulcrum 41*b*, and is provided below the rotation fulcrum 41*b* of the separating claw 41. Further, a lower end of the outer circumference of the guide roller 42 protrudes downward from the straight line L0 (see, FIG. 5) connecting the nip portion 34 of the fixing portion 30 and the nip portion 18*d* of the conveying roller pair 18.

In the second embodiment, the guide roller 44 is located between the rotation fulcrum 41*b* and the conveying roller pair 18, and below the rotation fulcrum 41*b*. The rotation center 41*e* of the guide roller 44 is located on downstream side of the guide roller 42. A lower end of the outer circumference of the guide roller 44 is located above a straight line L2 connecting the lower end of the outer circumference of the guide roller 42 and the nip portion 18*d* of the conveying roller pair 18. Further, the lower end of the outer circumference of the guide roller 44 is located below the rotation fulcrum 41*b* of the separating claw 41A, and is located on downstream side of the rotation fulcrum 41*b* of the separating claw 41A.

The configuration of the fixing device 50A of the second embodiment is the same as the fixing device 50 of the first embodiment (FIG. 2) except that the separating claw unit 40A has the guide roller 44.

[Operation of Fixing Device]

Figure 12:
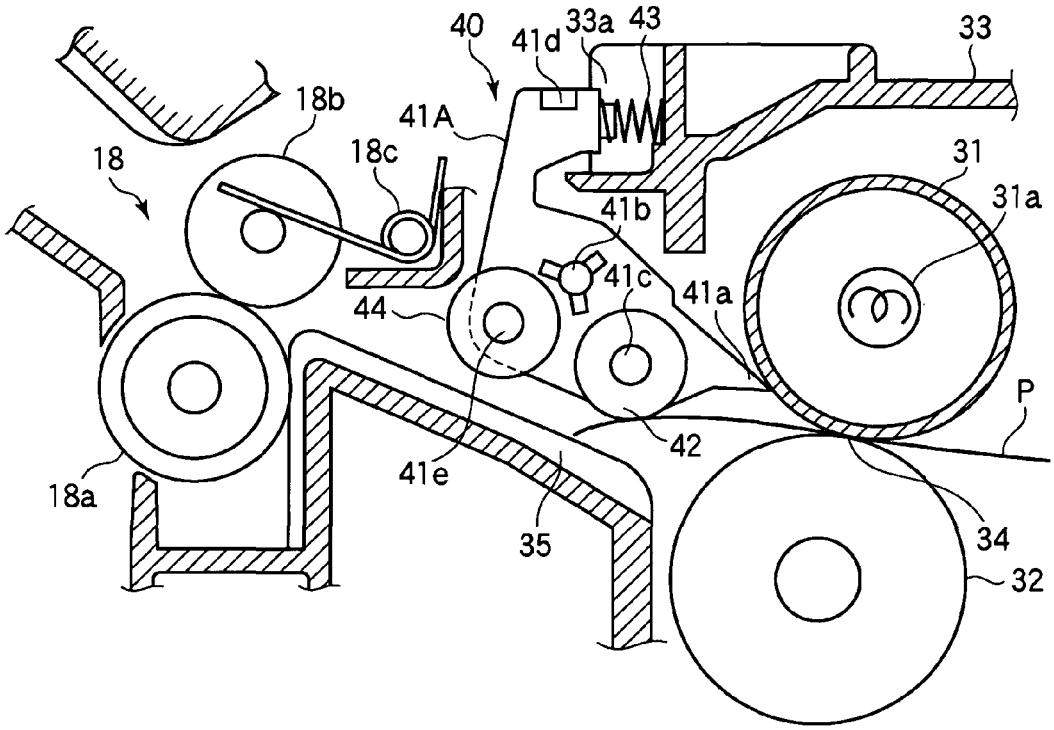
FIG. 12 is a schematic view showing a first state during a passage of a sheet through the fixing portion according to the second embodiment.

FIG. 12 is a schematic view for illustrating a first state of the separating claw unit 40A during the passage of the sheet P through the fixing portion 30.

The first state shown in FIG. 12 is a state after a leading end of the sheet P has passed the nip portion 34 between the heat roller 31 and the pressure roller 32, and just before the leading end of the sheet P reaches the guide roller 42.

The leading end of the sheet P having passed the nip portion 34 may move relatively downward, depending on a material of the sheet P or a material of a surface layer of the pressure roller 32. In this case, the leading end of the sheet P passes a vicinity of the pressure roller 32, and is separated from the heat roller 31 by itself. The sheet P is conveyed along a conveying path guide 35 without contacting the separating claw end 41*a*. Even if the conveyed sheet P contacts the guide roller 42, the separating claw end 41*a* is kept in contact with the heat roller 31 since the guide roller 42 is forced in upward direction by the sheet P (i.e., the separating claw unit 40A does not rotate).

Figure 13:
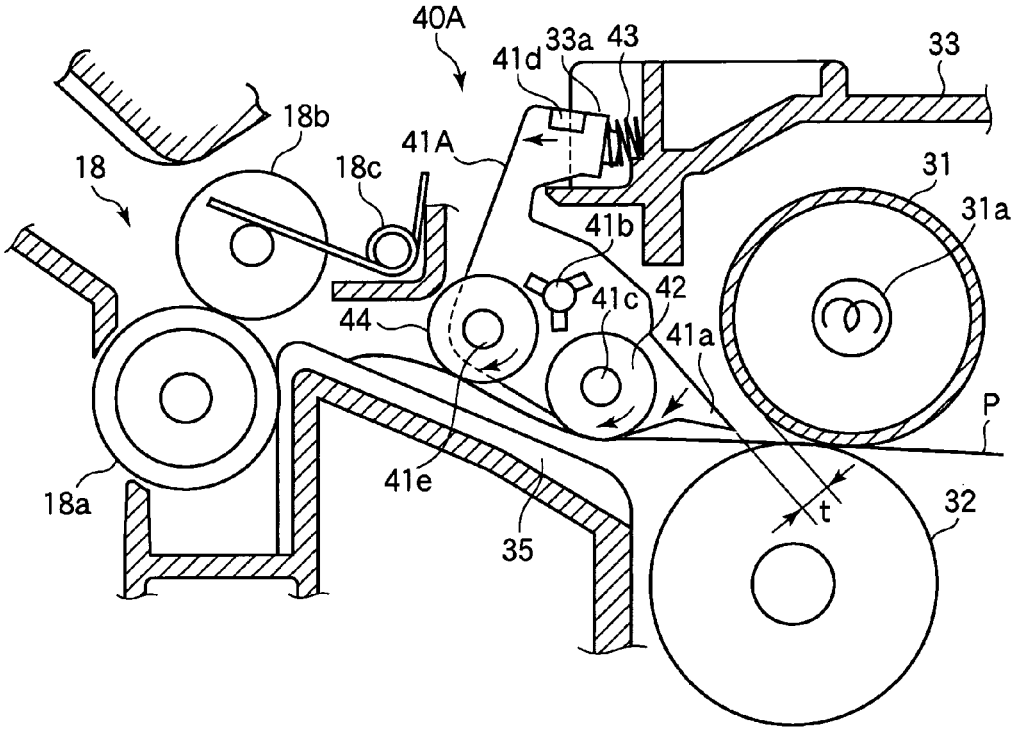
FIG. 13 is a schematic view showing a second state during the passage of the sheet through the fixing portion according to the second embodiment.

FIG. 13 is a schematic view for illustrating a second state of the separating claw unit 40A during the passage of the sheet P through the fixing portion 30.

The second state shown in FIG. 13 is a state where the leading end of the sheet P contacts the guide roller 44.

When the leading end of the sheet P (having been conveyed while contacting the guide roller 42 and the conveying path guide 35) contacts the guide roller 44, the sheet P forces the guide roller 44 so that the separating claw unit 40A rotates clockwise about the rotation fulcrum 41*b* resisting the force of the spring 43. With the rotation of the separation claw unit 40A, the separating claw end 41*a* moves apart from the heat roller 31.

In this state, a separating amount "t" between the separating claw end 41*a* and the heat roller 31 is determined by a position of the separating claw 41A when the separating claw projection 41*d* on the upper part of the separating claw 41A contacts the stopper 33*a* of the fixing portion cover 33*d*. The separating amount "t" is determined so that the separating claw end 41*a* having reached a lower end of a movable range thereof does not contact the sheet P.

Figure 14:
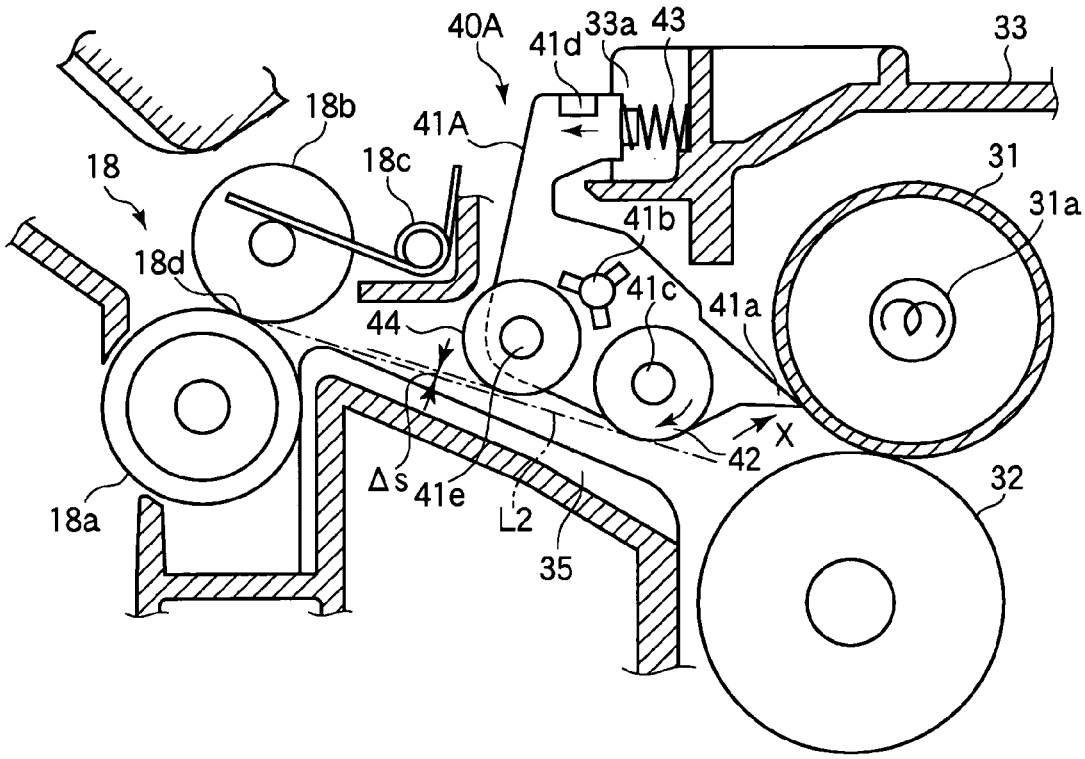
FIG. 14 is a schematic view showing a third state during the passage of the sheet through the fixing portion according to the second embodiment.

FIG. 14 is a schematic view showing a third state of the separating claw unit 40A during the passage of the sheet P through the fixing portion 30.

The third state shown in FIG. 14 is a state after the leading end of the sheet P reaches the conveying roller pair 18. When the leading end of the sheet P reaches the conveying roller pair 18, and when the sheet P proceeds on the straight line L2 connecting the lower end of the outer circumference of the guide roller 42 and the nip portion 18*d* of the conveying roller pair 18, the force causing the separating claw unit 40A to rotate clockwise (FIG. 14) disappears, since the guide roller 44 is located above the straight line L2 and does not contact the sheet P. Therefore, the separating claw unit 40A rotates to bring the separating claw end 41*a* in contact with the heat roller 31 due to the biasing force of the spring 43. Thereafter, the sheet P is conveyed by the conveying roller pair 18. While the sheet P is conveyed by the conveying roller pair 18, the separating claw end 41*a* is kept in contact with the heat roller 31. Further, after a tail end of the sheet P has passed the separating claw unit 40A, the separating claw end 41*a* is kept in contact with the heat roller 31.

It is preferable that the lower end of the outer circumference of the guide roller 44 is located above the straight line L2 connecting the lower end of the outer circumference of the guide roller 42 and the nip portion 18*d* (as the contact area) of the conveying roller pair 18 by an amount ΔS. When the sheet P reaches the conveying roller pair 18, the sheet P is stretched between the nip portion 18*d* (as the contact area) of the conveying roller pair 18, the guide roller 42, and the nip portion 34 (as the contact area between the heat roller 31 and the pressure roller 32).

In this state, a tensioning force of the sheet P acts on the separating claw unit 40A via the guide roller 42. Since the lower end of the outer circumference of the guide roller 42 is located above the straight line L2 connecting the lower end of the outer circumference of the guide roller 42 and the nip portion 18*d* of the conveying roller pair 18, the tensioning force of the stretched sheet P acts on the separating claw unit 40A only via the guide roller 42. Therefore, the tensioning force (i.e., an external force) acts on the guide roller 42 in a direction shown by an arrow X in FIG. 14 so that the separating claw end 41*a* contacts the heat roller 31.

Next, positional relationship between the guide roller 42, the rotation fulcrum 41*b* of the separating claw 41A, and the guide roller 44 will be described.

Figure 15:
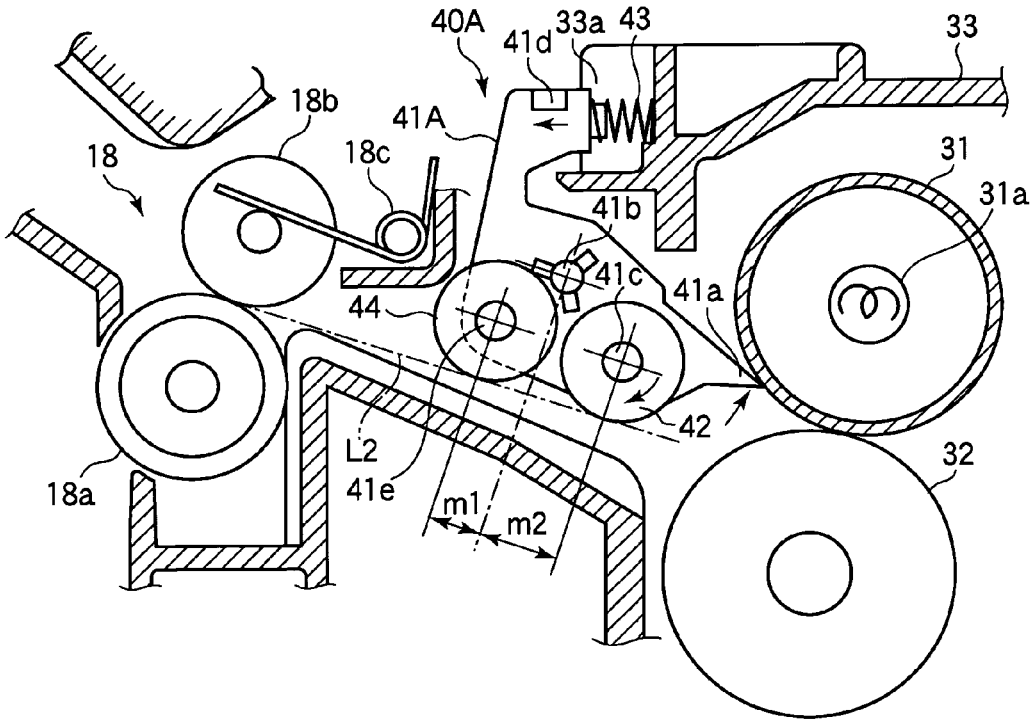
FIG. 15 is a schematic view showing a positional relationship between components according to the second embodiment.

FIG. 15 is a schematic view showing the positional relationship between the guide roller 42, the rotation fulcrum 41*b* of the separating claw 41A, and the guide roller 44.

In order that the guide roller 44 has a function to guide the sheet P toward the conveying roller pair 18, it is preferable that the guide roller 44 is located so as to contact the straight line L2. However, it is also necessary that the external force (i.e., the tensioning force) is applied to the separating claw unit 40A by the sheet P in a direction in which the separating claw end 41*a* contacts the heat roller 31 as described above.

In view of this, the guide roller 42, the rotation fulcrum 41*b* and the guide roller 44 are arranged in this order along the conveying direction of the sheet P from upstream (i.e., the fixing portion 30 side) to downstream (i.e., conveying roller pair 18 side). Further, a distance m1 between the rotation center 41*e* of the guide roller 44 and the rotation fulcrum 41*b* is set to be smaller than a distance m2 between the rotation center 41*c* of the guide roller 42 and the rotation fulcrum 41*b* (i.e., m1<m2).

In this regard, the distance m1 is a distance between the rotation center 41*e* and the rotation fulcrum 41*b*, which is projected onto the straight line L2 connecting the lower end of the outer circumference of the guide roller 42 and the nip portion 18*d* (as the contact area) of the conveying roller pair 18. Similarly, the distance m2 is a distance between the rotation center 41*c* and the rotation fulcrum 41*b*, which is projected onto the straight line L2.

With such a configuration, the external force acting on the guide roller 42 is larger than the external force acting on the guide roller 44. Therefore, the external force acts on the separating claw unit 40A by the sheet P in a direction to cause the separating claw end 41*a* to contact the heat roller 31.

[Advantage]

The second embodiment of the present invention provides the following advantage in addition to the advantages of the first embodiment.

The guide roller 42 and the guide roller 44 are provided at positions different from the rotation fulcrum 41*b* of the separating claw 41A, and the spring 43 generates the relatively small biasing force and allows the rotation of the separating claw unit 40 when the guide roller 42 is forced by the leading end of the sheet P. With such a configuration, the separating claw end 41*a* can separates the sheet P from the heat roller 31, even when the sheet P does not wind around the heat roller 31, but the leading end of the sheet P moves relatively downward. As a result, the occurrence of jam of the sheet P can be prevented.

Modifications

The above described embodiments can be modified as follows.

(A) In the first and second embodiment, descriptions have been made of the page printer as an example of the image forming apparatus. However, the present invention is not limited to such an example, but is applicable to, for example, a facsimile machine, a copier, an MTF (Multi-function Printer/Product/Peripheral) and the like.

(B) In the first and second embodiments, descriptions have been made of the fixing device 50 (50A) in the image forming apparatus 10 as an example of the separating device. However, the present invention is not limited to such an example, but is applicable to, for example, a receipt issuing device or the like used in an automatic transaction machine such as an automatic-teller machine (ATM).

(C) In the first and second embodiments, descriptions have been made of the fixing portion 30 as an example of the carrying-out portion that supplies the sheet P to the separating claw unit 40. However, the present invention is not limited to such an example, but is applicable to any carrying-out portion that carries out the medium.

(D) In the first and second embodiments, descriptions have been made of the conveying belt unit 17*h* (as the medium operating portion) and the fixing device 50 (50A) in the image forming apparatus 10 as an example of the medium conveying device. However, the present invention is not limited to such an example, but is applicable to, for example, a receipt issuing device or the like used in an automatic transaction machine such as an automatic-teller machine (ATM).

As described above, according to an aspect of the present invention, there is provided a separating device including a carrying-out portion for carrying-out a medium, a conveying portion for conveying the medium carried out by the carrying-out portion, and a separating portion provided between the carrying-out portion and the conveying portion so as to be rotatable about a rotation fulcrum. The separating portion has an end portion which is contactable and separable with the carrying-out portion. The end portion of the separating portion contacts the carrying-out portion to thereby separate the medium from the carrying-out portion. The separating portion includes a first guiding portion rotatably provided for guiding the medium separated from the carrying-out portion to the conveying portion. The first guiding portion is located between the carrying-out portion and the conveying portion, and has a rotation center which is located on the carrying-out portion side with respect to the rotation fulcrum of the separating portion. When a straight line is defined by connecting a contact area of the carrying-out portion and a contact area of the conveying portion, the rotation center of the first guiding portion is located on the straight line side with respect to the rotation fulcrum of the separating portion.

With such a configuration, the first guiding portion is provided on the separating portion at a position different from the rotation fulcrum. Further, when the leading end of the medium contacts the first guide portion, the biasing portion causes the separating portion to rotate with a relatively small force applied by the leading end portion of the medium. Therefore, the separating portion is apart from the carrying-out portion for a short time interval while the leading end portion of the medium passes the first guiding portion. Therefore, even when the medium (for example, a thin medium) has a tendency to wind around the carrying-out portion, the separating portion separates the medium from the carrying-out portion, and therefore the occurrence of the jam can be prevented.

Further, the separating portion separates from the carrying-out portion only when the medium passes the carrying-out portion, and therefore deposition of extraneous matter on the separating portion is not likely to occur. As a result, a surface and a back surface of the medium can be prevented from being smeared with the extraneous matter.

Furthermore, the separating portion can rotate about the rotation fulcrum along the conveying direction of the medium so as to move the separating portion apart from the carrying-out portion, and therefore a force applied to the separating portion by the medium when the medium contacts the first guide portion can be dispersed in the conveying direction of the medium. Therefore, wrinkling, folding and jam of the medium (that may otherwise occur when the medium contacts the first guide portion) can be prevented.

According to another aspect of the present invention, there is provided a separating device including a fixing portion that fixes a developer to a medium and carries out the medium therefrom, a conveying portion provided on downstream side of the fixing portion in a conveying direction of the medium, a separating portion provided between the fixing portion and the conveying portion, and a biasing portion that biases the separating portion in a direction in which the separating portion contacts the fixing portion. The separating portion includes a separating claw biased by the biasing portion to contact the fixing portion so as to separate the medium from the fixing portion, a first guiding portion rotatably provided on the separating claw so as to protrude from a first straight line connecting a contact area of the fixing portion and a contact area of the conveying portion, and a rotation fulcrum provided on downstream side of the first guiding portion in the conveying direction of the medium. The rotation fulcrum supports the separating claw so that the separating claw is movable to contact with or separate from the fixing portion.

According to still another aspect of the present invention, there is provided a medium conveying device including the above described separating device. The medium conveying device further includes a medium operating portion that performs a predetermined operation on the medium, and supplies the medium to the separating device.

According to yet another aspect of the present invention, there is provided a fixing device including the above described separating device. The fixing portion includes a heat roller that heats the medium when the medium passes the heat roller, and a pressure roller that applies a pressure to the medium between the heat roller and the pressure roller.

According to further aspect of the present invention, there is provided an image forming apparatus including the above described separating device. The image forming apparatus further includes an image forming portion that forms a developer image using a developer, transfers the developer image to the medium, and supplies the medium with the developer image to the separating device.

According to still further aspect of the present invention, there is provided an image forming apparatus wherein the image forming portion includes a developer storage portion storing the developer, an image bearing body that bears a latent image, an exposure unit that forms the latent image on the image bearing body to form the developer image, and a transferring portion that transfers the developer image from the image bearing body to the medium and supplies the medium to the separating device.

While the preferred embodiments of the present invention have been illustrated in detail, it should be apparent that modifications and improvements may be made to the invention without departing from the spirit and scope of the invention as described in the following claims.

What is claimed is:

1. A separating device, comprising:

a fixing portion including a first fixing member and a second fixing member that contact each other and form a fixing nip portion therebetween, said first fixing member and said second fixing member being configured to fix a developer to a medium at said fixing nip portion and to convey said medium through said fixing nip portion;

a conveying portion provided on a downstream side of said fixing portion in a conveying direction of said medium, said conveying portion including a first conveying member and a second conveying member that contact each other and form a conveying nip portion therebetween, said first conveying member and said second conveying member being configured to convey said medium through said conveying nip portion;

a separating portion provided between said fixing portion and said conveying portion; and a biasing portion that biases said separating portion in a direction in which said separating portion contacts said fixing portion;

wherein said separating portion comprises:

a separating claw biased by said biasing portion to contact said first fixing member so as to separate said medium from said first fixing member;

a first guiding portion rotatably provided on said separating claw, said first guiding portion being movable along with said separating claw; and a rotation fulcrum provided on a downstream side of said first guiding portion in said conveying direction of said medium, said rotation fulcrum supporting said separating claw so that said separating claw is movable to contact with or separate from said first fixing member;

wherein said separating claw contacts with or separates from said first fixing member based on said first guiding portion being biased by said medium;

wherein said first guiding portion protrudes to a side opposite to said rotation fulcrum across a first straight line connecting a terminal point of said fixing nip portion of said fixing portion and a starting point of said conveying nip portion of said conveying portion;

wherein said first guiding portion protrudes to the side opposite to said rotation fulcrum across said first straight line, irrespective of whether said first guiding portion is biased by said medium or not;

wherein said separating portion further comprises a second guiding portion rotatably provided on said separating claw for guiding said medium separated from said fixing portion to said conveying portion; and wherein said second guiding portion is located between said rotation fulcrum and said conveying portion and below said rotation fulcrum in a vertical direction, said second guiding portion being located so that a lower end of an outer circumference thereof contacts a second straight line connecting a lower end of an outer circumference of said first guiding portion and said conveying nip portion of said conveying portion.

2. The separating device according to claim 1, wherein said second guiding portion is located on the downstream side of said first guiding portion in said conveying direction of said medium, and is located on an upstream side of said conveying portion in said conveying direction of said medium.

3. The separating device according to claim 1, wherein said first guiding portion is rotatable about a rotation center provided on said separating claw, said rotation center being located between said rotation fulcrum and said fixing portion and below said rotation fulcrum in a vertical direction.

4. The separating device according to claim 1, wherein said first guiding portion and said second guiding portion are located so that a distance between a rotation center of said first guiding portion and said rotation fulcrum is larger than a distance between a rotation center of said second guiding portion and said rotation fulcrum.

5. The separating device according to claim 4, wherein said first guiding portion and said second guiding portion respectively comprise rollers.

6. The separating device according to claim 1, wherein said first guiding portion comprises a roller.

7. A fixing device comprising said separating device according to claim 1, wherein said first fixing member of said fixing portion comprises a heat roller that heats said medium when said medium passes said heat roller; and wherein said second fixing member of said fixing portion comprises a pressure roller that applies a pressure to said medium between said heat roller and said pressure roller.

8. A medium conveying device comprising:

said separating device according to claim 1; and a medium operating portion that performs a predetermined operation on said medium and supplies said medium to said separating device.

9. An image forming apparatus comprising:

said separating device according to claim 1; and an image forming portion that forms a developer image using a developer, transfers said developer image to said medium, and supplies said medium to said separating device.

10. The image forming apparatus according to claim 9, wherein said image forming portion comprises:

a developer storage portion that stores said developer;

an image bearing body that bears a latent image;

an exposure unit that forms said latent image on said image bearing body to form said developer image; and a transferring portion that transfers said developer image from said image bearing body to said medium, and supplies said medium to said separating device.

11. A separating device, comprising:

a fixing portion including a first fixing member and a second fixing member that contact each other and form a fixing nip portion therebetween, said first fixing member and said second fixing member being configured to fix a developer to a medium at said fixing nip portion and to convey said medium through said fixing nip portion;

a conveying portion provided on a downstream side of said fixing portion in a conveying direction of said medium, said conveying portion including a first conveying member and a second conveying member that contact each other and form a conveying nip portion therebetween, said first conveying member and said second conveying member being configured to convey said medium through said conveying nip portion;

a separating portion provided between said fixing portion and said conveying portion; and a biasing portion that biases said separating portion in a direction in which said separating portion contacts said fixing portion;

wherein said separating portion comprises:

a separating claw biased by said biasing portion to contact said first fixing member so as to separate said medium from said first fixing member;

a first guiding portion rotatably provided on said separating claw, said first guiding portion being movable along with said separating claw; and a rotation fulcrum provided on a downstream side of said first guiding portion in said conveying direction of said medium, said rotation fulcrum supporting said separating claw so that said separating claw is movable to contact with or separate from said first fixing member;

wherein said separating claw contacts with or separates from said first fixing member based on said first guiding portion being biased by said medium;

wherein said first guiding portion protrudes to a side opposite to said rotation fulcrum across a first straight line connecting a terminal point of said fixing nip portion of said fixing portion and a starting point of said conveying nip portion of said conveying portion;

wherein said first guiding portion protrudes to the side opposite to said rotation fulcrum across said first straight line, irrespective of whether said first guiding portion is biased by said medium or not;

wherein said separating portion further comprises a second guiding portion rotatably provided on said separating claw for guiding said medium separated from said fixing portion to said conveying portion;

wherein said second guiding portion is located between said rotation fulcrum and said conveying portion and below said rotation fulcrum in a vertical direction, said second guiding portion being located above a second straight line connecting a lower end of an outer circumference of said first guiding portion and said conveying nip portion of said conveying portion; and wherein said first guiding portion and said second guiding portion are located so that a distance between a rotation center of said first guiding portion and said rotation fulcrum is larger than a distance between a rotation center of said second guiding portion and said rotation fulcrum.

12. A separating device, comprising:

a fixing portion including a first fixing member and a second fixing member that contact each other and form a fixing nip portion therebetween, said first fixing member and said second fixing member being configured to fix a developer to a medium at said fixing nip portion and to convey said medium through said fixing nip portion;

a conveying portion provided on a downstream side of said fixing portion in a conveying direction of said medium, said conveying portion including a first conveying member and a second conveying member that contact each other and form a conveying nip portion therebetween, said first conveying member and said second conveying member being configured to convey said medium through said conveying nip portion;

a separating portion provided between said fixing portion and said conveying portion; and a biasing portion that biases said separating portion in a direction in which said separating portion contacts said fixing portion;

wherein said separating portion comprises:

a separating claw biased by said biasing portion to contact said first fixing member so as to separate said medium from said first fixing member;

a first guiding portion rotatably provided on said separating claw, said first guiding portion being movable along with said separating claw; and a rotation fulcrum provided on a downstream side of said first guiding portion in said conveying direction of said medium, said rotation fulcrum supporting said separating claw so that said separating claw is movable to contact with or separate from said first fixing member;

wherein said separating claw contacts with or separates from said first fixing member based on said first guiding portion being biased by said medium;

wherein said first guiding portion protrudes to a side opposite to said rotation fulcrum across a first straight line connecting a terminal point of said fixing nip portion of said fixing portion and a starting point of said conveying nip portion of said conveying portion;

wherein said first guiding portion protrudes to the side opposite to said rotation fulcrum across said first straight line, irrespective of whether said first guiding portion is biased by said medium or not;

wherein said separating portion further comprises a second guiding portion rotatably provided on said separating claw;

wherein said second guiding portion is located on the downstream side of said first guiding portion in said conveying direction of said medium, and is located on an upstream side of said conveying portion in said conveying direction of said medium; and wherein said first guiding portion and said second guiding portion are located so that a distance between a rotation center of said first guiding portion and said rotation fulcrum is larger than a distance between a rotation center of said second guiding portion and said rotation fulcrum.

* * * * *